US010677013B2

(12) United States Patent
Hazel

(10) Patent No.: US 10,677,013 B2
(45) Date of Patent: Jun. 9, 2020

(54) ANNULAR BARRIER WITH SHUNT TUBE

(71) Applicant: Welltec Oilfield Solutions AG, Zug (CH)

(72) Inventor: Paul Hazel, Aberdeen (GB)

(73) Assignee: Welltec Oilfield Solutions AG, Zug (CH)

( * ) Notice: Subject to any disclaimer, the term of this patent is extended or adjusted under 35 U.S.C. 154(b) by 0 days.

(21) Appl. No.: 15/642,505

(22) Filed: Jul. 6, 2017

(65) Prior Publication Data

US 2018/0010414 A1 Jan. 11, 2018

(30) Foreign Application Priority Data

Jul. 7, 2016 (EP) ..... 16178457

(51) Int. Cl.
*E21B 33/127* (2006.01)
*E21B 43/04* (2006.01)
(Continued)

(52) U.S. Cl.
CPC ..... *E21B 33/127* (2013.01); *E21B 33/1243* (2013.01); *E21B 33/1277* (2013.01); *E21B 43/04* (2013.01); *E21B 43/08* (2013.01)

(58) Field of Classification Search
CPC .. E21B 33/12; E21B 33/1243; E21B 33/1277; E21B 43/04; E21B 43/08
See application file for complete search history.

(56) References Cited

U.S. PATENT DOCUMENTS 6,640,893 B1 * 11/2003 Rummel ..... E21B 33/1208 166/187
8,960,287 B2 * 2/2015 Holderman ..... E21B 43/04 166/242.2

(Continued)

FOREIGN PATENT DOCUMENTS

EP 2 184 436 5/2010
EP 2 565 368 3/2013

OTHER PUBLICATIONS

Extended Search Report for EP16178457.4, dated Dec. 20, 2016, 12 pages.

*Primary Examiner* — David J Bagnell
*Assistant Examiner* — Yanick A Akaragwe
(74) *Attorney, Agent, or Firm* — Nixon & Vanderhye P.C.

(57) ABSTRACT

The present invention relates to an annular barrier for isolating a production zone, the annular barrier having a first end and a second end, comprising: a tubular metal part for mounting as part of a well tubular metal structure, the tubular metal part having an outer face, an expandable metal sleeve surrounding the tubular metal part and having an outer face facing a wall of a borehole, each end of the expandable metal sleeve being connected with the tubular metal part, an annular space arranged between the expandable metal sleeve and the tubular metal part, the expandable metal sleeve being configured to expand by pressurised fluid entering the annular space, a first tubular metal connection assembly surrounding the tubular metal part connecting one end of the expandable metal sleeve with the tubular metal part and a second tubular metal connection assembly surrounding the tubular metal part connecting the other end of the expandable metal sleeve with the tubular metal part, each tubular metal connection assembly having a wall, and a shunt tube, wherein the tubular metal connection assemblies have at least one opening in the wall through which the shunt (Continued)

Figure 1:
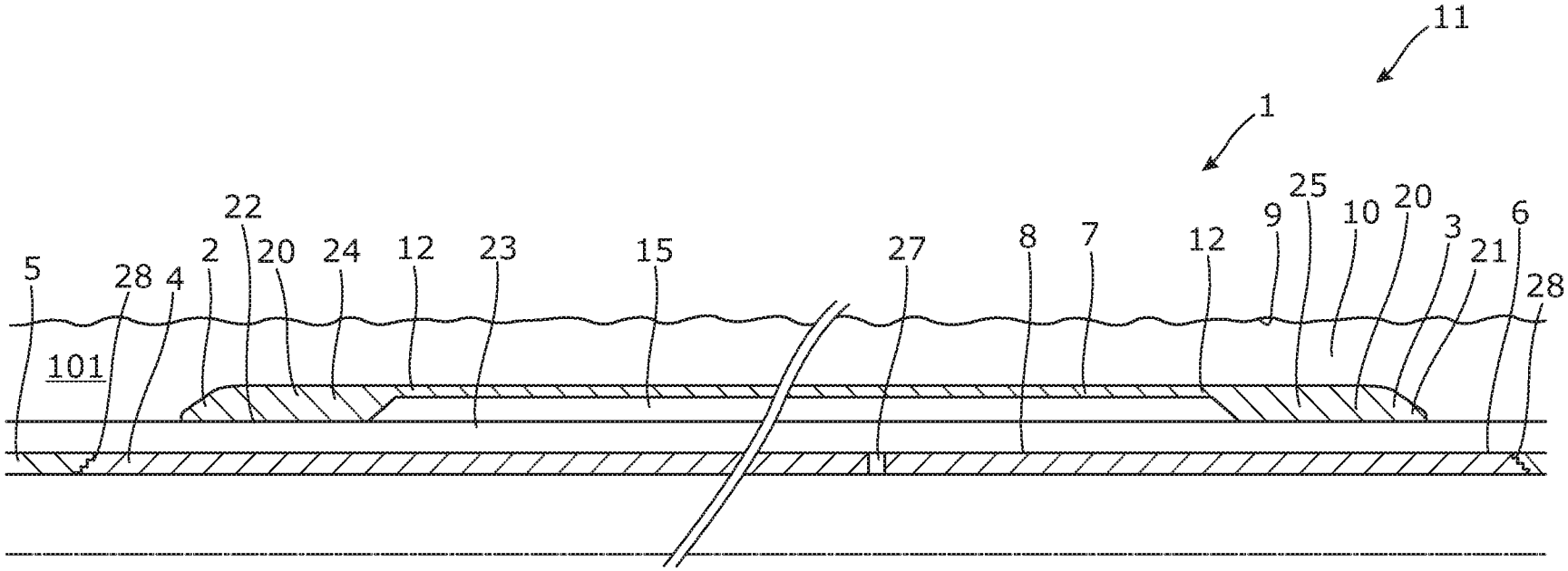

tube extends, the shunt tube extending along and outside the tubular metal part from the first end via the annular space to the second end. Furthermore, the present invention relates to a downhole completion system for completing a well and to an expansion method for expanding an annular barrier.

23 Claims, 11 Drawing Sheets

(51) Int. Cl.
*E21B 43/08* (2006.01)
*E21B 33/124* (2006.01)

(56) References Cited

U.S. PATENT DOCUMENTS

| | | | | |
|---|---|---|---|---|
| 2002/0189821 | A1 | 12/2002 | Watson et al. | |
| 2005/0039917 | A1 | 2/2005 | Hailey, Jr. | |
| 2010/0032158 | A1 | 2/2010 | Dale et al. | |
| 2010/0096119 | A1* | 4/2010 | Sevre | E21B 23/04 166/51 |
| 2015/0275587 | A1* | 10/2015 | Wolf | E21B 17/02 166/380 |

* cited by examiner

ANNULAR BARRIER WITH SHUNT TUBE

This application claims priority to EP Patent Application No. 16178457.4 filed 7 Jul. 2016, the entire content of which is hereby incorporated by reference.

The present invention relates to an annular barrier for isolating a production zone. Furthermore, the present invention also relates to a downhole completion system for completing a well and to an expansion method for expanding an annular barrier.

When producing hydrocarbons from a reservoir downhole, gravel is, in some wells, injected into the production zone to keep the production zone from collapsing during producing. In very long or deep wells, it may be a problem to provide gravel down the annulus formed between the wall of the borehole and the well tubular metal structure, since the gravel packs prevent movement of the gravel further down the well. Therefore, in such completion design, one or more shunt tubes are provided from the top of the well on the outside of the well tubular metal structure. The shunt tubes have a smooth inner surface and thus prevent packing of the gravel and the gravel can therefore be ejected further down the deep or long well.

In other wells, isolation of the production zones is more important and the completion is thus designed to isolate the production zones by means of annular barriers. However, by providing such isolation, the shunt tubes cannot extend on the outside of the well tubular metal structure, and gravel needs to be provided from within the well tubular metal structure and out through openings in the well tubular metal structure opposite the zones, which induces the risk of the well tubular metal structure, and not the annulus, being filled up with gravel.

It is an object of the present invention to wholly or partly overcome the above disadvantages and drawbacks of the prior art. More specifically, it is an object to provide an improved completion design in which both production zones are isolated and gravel can be provided further down the well.

The above objects, together with numerous other objects, advantages and features, which will become evident from the below description, are accomplished by a solution in accordance with the present invention by an annular barrier for isolating a production zone, the annular barrier having a first end and a second end, comprising:

- a tubular metal part for mounting as part of a well tubular metal structure, the tubular metal part having an outer face,
- an expandable metal sleeve surrounding the tubular metal part and having an outer face facing a wall of a borehole, each end of the expandable metal sleeve being connected with the tubular metal part,
- an annular space arranged between the expandable metal sleeve and the tubular metal part, the expandable metal sleeve being configured to expand by pressurised fluid entering the annular space, and
- a tubular metal connection assembly surrounding the tubular metal part configured to connect at least one end of the expandable metal sleeve with the tubular metal part, the tubular metal connection assembly having a wall, wherein the tubular metal connection assembly has at least one opening in the wall through which a shunt tube extends, the shunt tube extending along and outside the tubular metal part from the first end via the annular space to the second end.

The present invention also relates to an annular barrier for isolating a production zone, the annular barrier having a first end and a second end, comprising:

- a tubular metal part for mounting as part of a well tubular metal structure, the tubular metal part having an outer face,
- an expandable metal sleeve surrounding the tubular metal part and having an outer face facing a wall of a borehole, each end of the expandable metal sleeve being connected with the tubular metal part,
- an annular space arranged between the expandable metal sleeve and the tubular metal part, the expandable metal sleeve being configured to expand by pressurised fluid entering the annular space,
- a first tubular metal connection assembly surrounding the tubular metal part connecting one end of the expandable metal sleeve with the tubular metal part and a second tubular metal connection assembly surrounding the tubular metal part connecting the other end of the expandable metal sleeve with the tubular metal part, each tubular metal connection assembly having a wall, and
- a shunt tube, wherein the tubular metal connection assemblies have at least one opening in the wall through which the shunt tube extends, the shunt tube extending along and outside the tubular metal part from the first end via the annular space to the second end.

The shunt tube may extend underneath the expandable metal sleeve.

Moreover, the shunt tube may be without openings opposite the expandable space.

Further, the shunt tube may be a bypass tube bypassing the expandable space.

In addition, the expandable metal sleeve may be tubular and connected to or may form part of an outer face of the tubular metal connection assemblies, so that the connection there between forms a circular connection when seen in cross-section.

By having a circular connection between the expandable metal sleeve and the tubular metal connection assemblies, a sufficient seal can be provided there between without decreasing the expandability and the collapse rating of the expandable metal sleeve by a simple weld connection.

The opening may have a cross-section area, the cross-section area being larger than 2 $cm^2$, preferably larger than 4 $cm^2$, and more preferably larger than 8 $cm^2$.

The openings may have a common cross-sectional area being preferably larger than 8 $cm^2$.

Also, the shunt tube may be a gravel shunt tube.

Moreover, the tubular metal connection assembly may have a varying outer diameter.

Further, the opening may be provided in the wall part having the largest outer radius.

The tubular metal connection assembly may be an oval cross-section.

Furthermore, the tubular metal connection assembly may have a plurality of openings in the wall through which a plurality of shunt tubes extend.

In addition, the annular barrier may comprise part of the shunt tube.

Moreover, the shunt tube may have several openings.

Further, the opening may have a cross-sectional shape which is circular, bean-shaped, square-shaped or similar.

Each tubular metal connection assembly may have an assembly length, the shunt tube may have a shunt length and the expandable metal sleeve may have a sleeve length in the unexpanded position, the shunt length being equal to or larger than the sleeve length and/or the assembly length.

Furthermore, the tubular metal connection assemblies and the expandable metal sleeve may be made in one piece.

Also, a connection member may be arranged outside the tubular metal connection assembly, the connection member being configured to connect the expandable metal sleeve to the tubular metal connection assembly.

The tubular metal part may have an expansion opening arranged opposite the annular space through which pressurised fluid may enter into the annular space in order to expand the expandable metal sleeve.

In addition, the end of expandable metal sleeve may be arranged between the connection member and the tubular metal connection assembly. The expandable metal sleeve may thus be fastened there between as the end of the expandable metal sleeve is squeezed there between.

Moreover, sealing means may be arranged between the opening and the shunt tube.

An expansion opening may be arranged in the tubular metal part through which pressurised fluid may enter into the annular space in order to expand the expandable metal sleeve.

Further, the tubular metal part may comprise production openings.

Additionally, the shunt tube may have an expansion opening arranged opposite the annular space through which pressurised fluid may enter into the annular space in order to expand the expandable metal sleeve.

Also, the shunt tube may have shunt openings for ejecting of gravel.

Furthermore, the tubular metal connection assembly may comprise a fluid channel for fluidly connecting the expansion opening and the space.

The expandable metal sleeve may be expanded by pressurising the shunt tube and letting the pressurised fluid into the space in order to expand the expandable metal sleeve.

The present invention also relates to a downhole completion system for completing a well having a top and a borehole, comprising:

- a well tubular metal structure extending in the borehole,
- an annular barrier as described above and mounted as part of the well tubular metal structure, and
- a shunt tube extending along the well tubular metal structure from the top of the well through the annular barrier.

The downhole completion system as described above may further comprise a screen assembly mounted as part of the well tubular metal structure.

Moreover, the shunt tube may extend underneath the screen assembly.

Also, the shunt tube may have several sidetracks along the well tubular metal structure opposite the screen assemblies.

Said sidetracks may have openings.

Moreover, the screen assembly may comprise a screen surrounding a base part which is mounted as part of the well tubular metal structure.

Further, the shunt tube may extend on the outside of the screen assembly.

Also, the shunt tube may extend between the screen and the base part of the screen assembly.

In addition, the shunt tube may have at least one sidetrack along the well tubular metal structure opposite the screen assembly.

Said sidetrack may extend on an outside of the screen assembly.

The present invention furthermore relates to an expansion method for expanding an annular barrier as described above, comprising:

- expanding the expandable metal sleeve of the annular barrier by letting the pressurised fluid into the space through an expansion opening in the shunt tube opposite the space.

The expansion method as described above may further comprise:

- mounting the tubular metal part as part of the well tubular metal structure,
- inserting the well tubular metal structure into the borehole, and
- pressurising fluid in the shunt tube.

Figure 2:
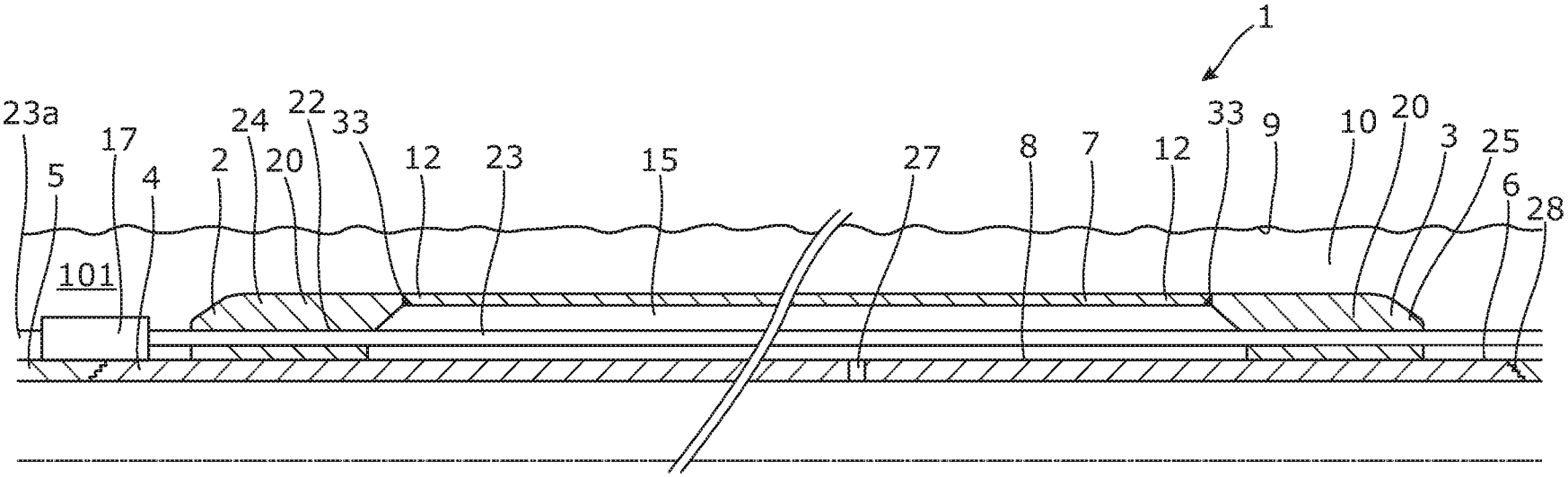
Figure 3:
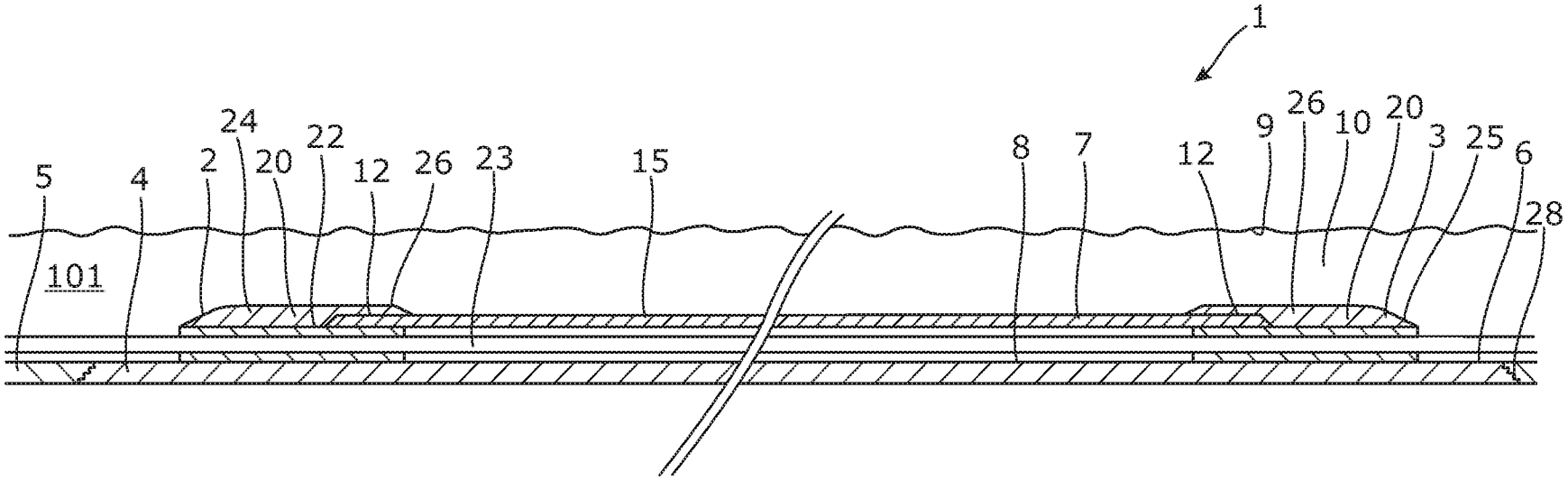
Figure 4:
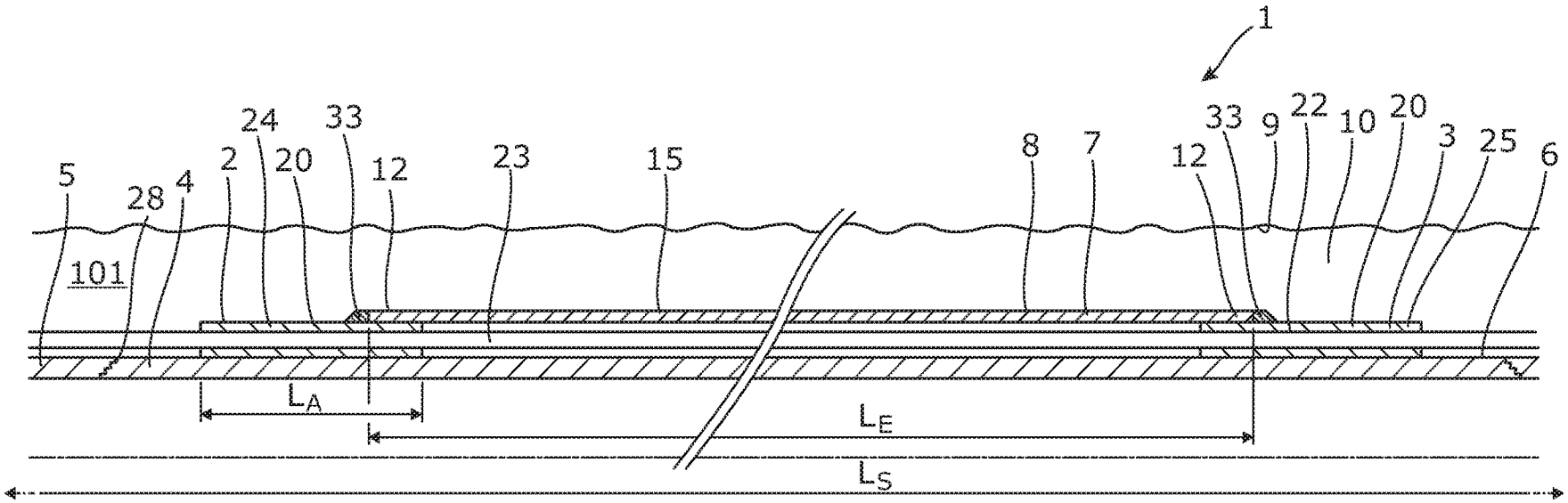
Figure 5:
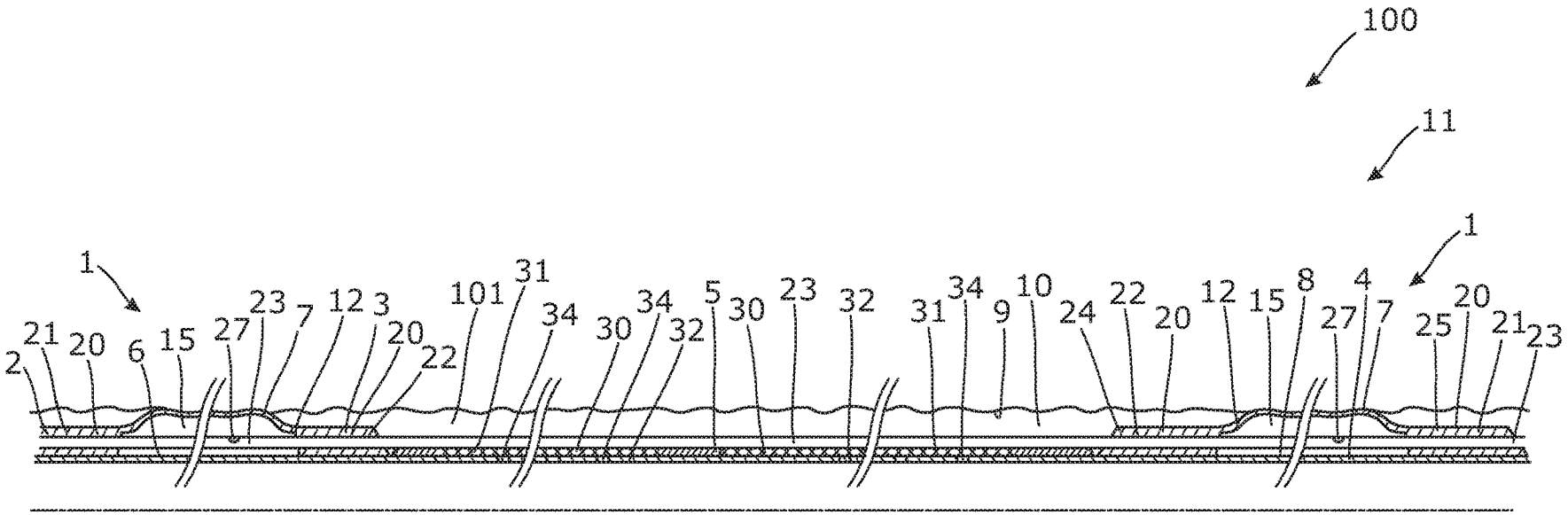
Figure 6:
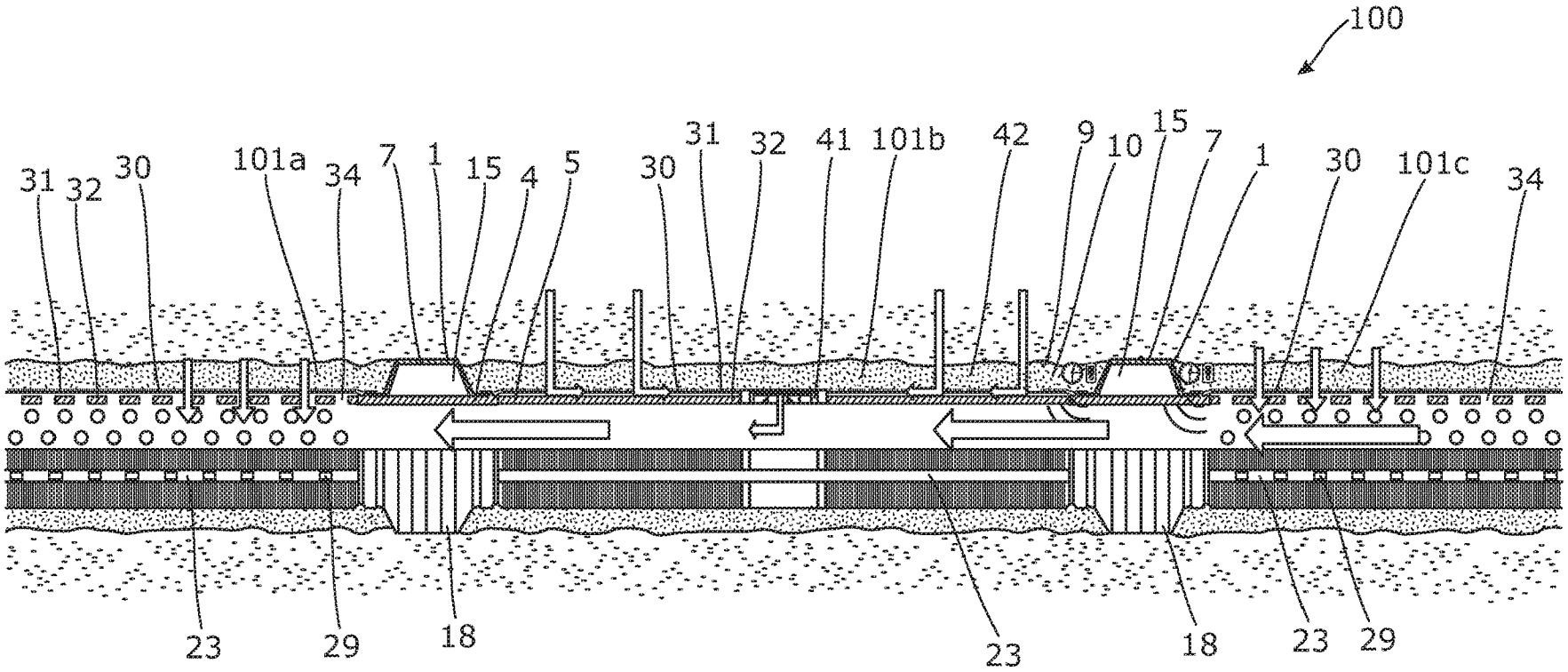
Figure 7:
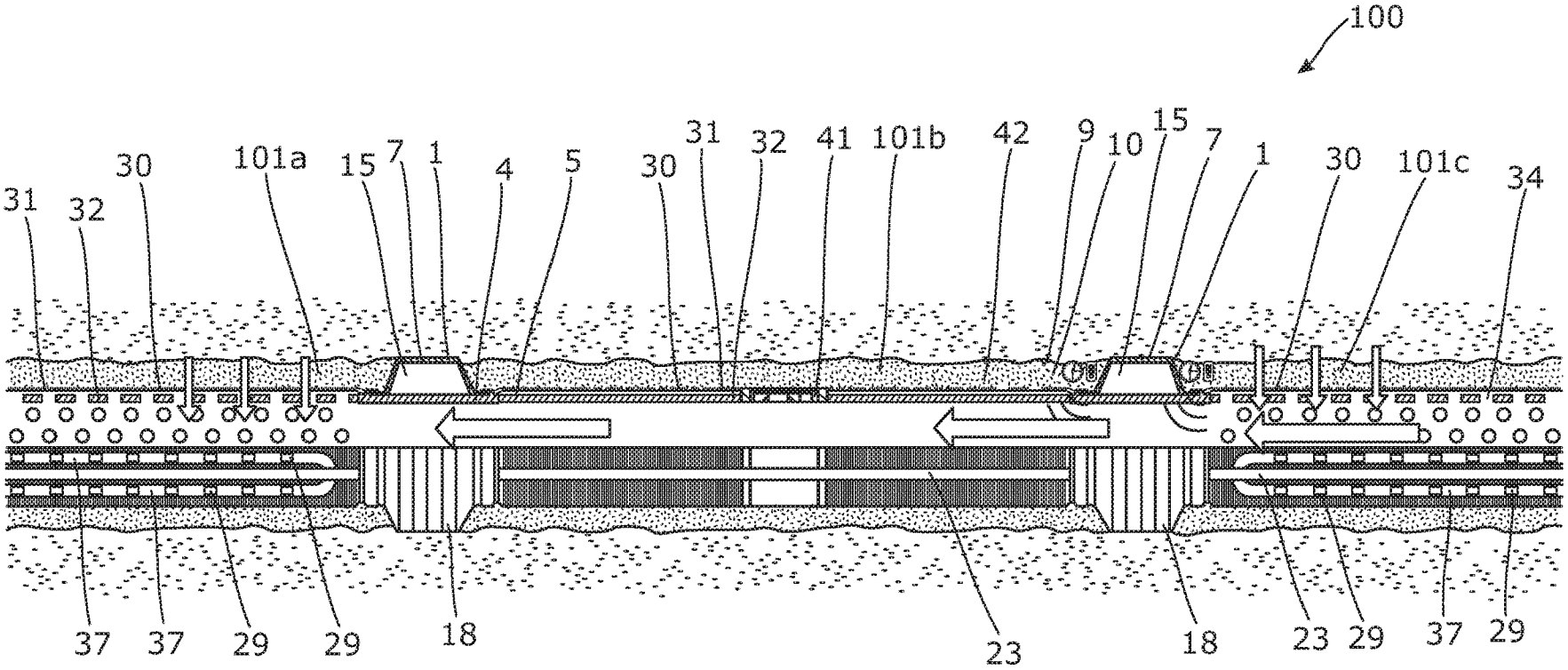

The invention and its many advantages will be described in more detail below with reference to the accompanying schematic drawings, which for the purpose of illustration show some non-limiting embodiments and in which FIG. 1 shows a cross-sectional view of an annular barrier, FIG. 2 shows a cross-sectional view of another annular barrier having a welded connection for fastening the expandable metal sleeve to the tubular metal part, FIG. 3 shows a cross-sectional view of yet another annular barrier, having two connections parts for fastening the expandable metal sleeve, FIG. 4 shows a cross-sectional view of another annular barrier, FIG. 5 shows a cross-sectional view of downhole completion system, FIG. 6 shows a partly cross-sectional view of downhole completion system, FIG. 7 shows a partly cross-sectional view of downhole completion system, and FIGS. 8-14 show partly cross-sectional views of different annular barriers seen from one end.

All the figures are highly schematic and not necessarily to scale, and they show only those parts which are necessary in order to elucidate the invention, other parts being omitted or merely suggested.

FIG. 1 shows an annular barrier 1 for isolating a production zone 101 in a well 11 downhole. The annular barrier comprises a first end 2 and a second end 3 and further comprises a tubular metal part 4 for mounting as part of a well tubular metal structure 5. The tubular metal part has an outer face 6 facing an expandable metal sleeve 7 which surrounds the tubular metal part and has an outer face 8 facing a wall 9 of a borehole 10. Each end 12 of the expandable metal sleeve is connected with the tubular metal part, defining an annular space 15 between the expandable metal sleeve and the tubular metal part. The expandable metal sleeve 7 is configured to expand by entering pressurised fluid into the annular space. The annular barrier further comprises a first tubular metal connection assembly 20, 24 and a second tubular metal connection assembly 20, 25 surrounding the tubular metal part 4 and configured to connect the end 12 of the expandable metal sleeve with the tubular metal part.

The tubular metal connection assemblies have a wall 21 in which an opening 22 is provided and through which opening a shunt tube 23 extends. The shunt tube extends along an outer face 8 of the tubular metal part from the first end 2 via the annular space 15 to the second end 3 underneath the expandable metal sleeve 7.

In FIG. 1, the tubular metal connection assemblies 20, 24, 25 are thus configured to each connect an end of the expandable metal sleeve to the tubular metal part 4. The tubular metal connection assemblies 20 and the expandable metal sleeve 7 are made in one piece and are machined from one metal blank. The tubular metal part 4 is mounted as part of the well tubular metal structure by means of threaded connections 28. The pressurised fluid for expanding the expandable metal sleeve enters through an expansion opening 27 in the tubular metal part 4 from within the well tubular metal structure 5. The shunt tube 23 is a gravel shunt tube configured to provide gravel 42 to a zone 101*b* downhole in the borehole 10 through shunt openings 29, as shown in FIG. 6.

When producing hydrocarbons from a reservoir downhole, gravel is, in some wells, injected into the production zone to keep the production zone from collapsing during producing. In very long or deep wells, it may be a problem to provide gravel down the annulus formed between the wall of the borehole and the well tubular metal structure, since the gravel packs prevent movement of the gravel further down the well. Therefore, in such completion design, shunt tubes are provided from the top of the well on the outside of the well tubular metal structure, said shunt tubes having a smooth inner surface and thus preventing packing of the gravel, and thus the gravel can be ejected all the way down the deep or long well. In other wells, isolation of the production zones is more important and the completion design is thus to isolate the production zones by annular barriers. However, by providing such isolation, the shunt tubes cannot extend on the outside of the well tubular metal structure. By having the tubular metal connection assemblies, the shunt tube can extend past the annular barrier, and the two different completion designs can thus be combined to provide a more optimal production and expand of the lifetime of the well, and the completion design is no longer a choice between the one or the other design.

Figure 14:
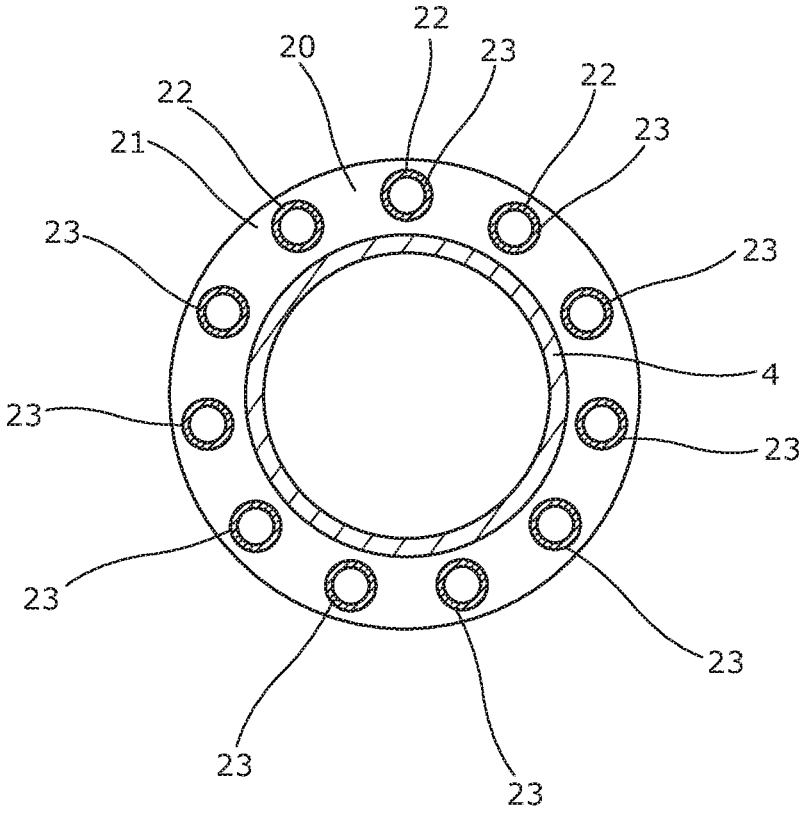

In FIG. 2, the expandable metal sleeve 7 is welded by welded connections 33 to the connections parts 24, 25, respectively. The annular barrier 1 comprises several shunt tubes 23, as shown in FIG. 14, and these shunt tubes are fluidly connected in a shunt collection unit 17. In FIG. 9, which shows the annular barrier 1 of FIG. 3 from one end, the tubular metal connection assembly 20 has a varying outer diameter OD (shown in FIG. 8) and thus an oval cross-section. And the shunt tube 23 extends through the opening provided in the part of the wall 21 having the largest outer radius $OR_2$ and the opposite part of the wall has a smaller outer radius $OR_1$.

In FIG. 3, a connection member 26 is arranged outside each tubular metal connection assembly 20 and configured to connect the expandable metal sleeve 7 to the tubular metal connection assemblies and thus to the tubular metal part 4. Each end of the expandable metal sleeve is thus arranged between the connection member and the tubular metal connection assembly, and the expandable metal sleeve is thereby fastened as the end of the expandable metal sleeve is squeezed therebetween.

The expandable metal sleeve 7 of the annular barrier 1 may also be connected to the outside of the tubular metal connection assemblies 20 by welding, as shown in FIG. 4. Each tubular metal connection assembly 20 has an assembly length $L_A$, the shunt tube has a shunt length $L_S$ and the expandable metal sleeve has a sleeve length $L_E$ in the unexpanded position, as shown in FIG. 4. The shunt length is equal to or larger than the sleeve length and the assembly length.

Figure 8:
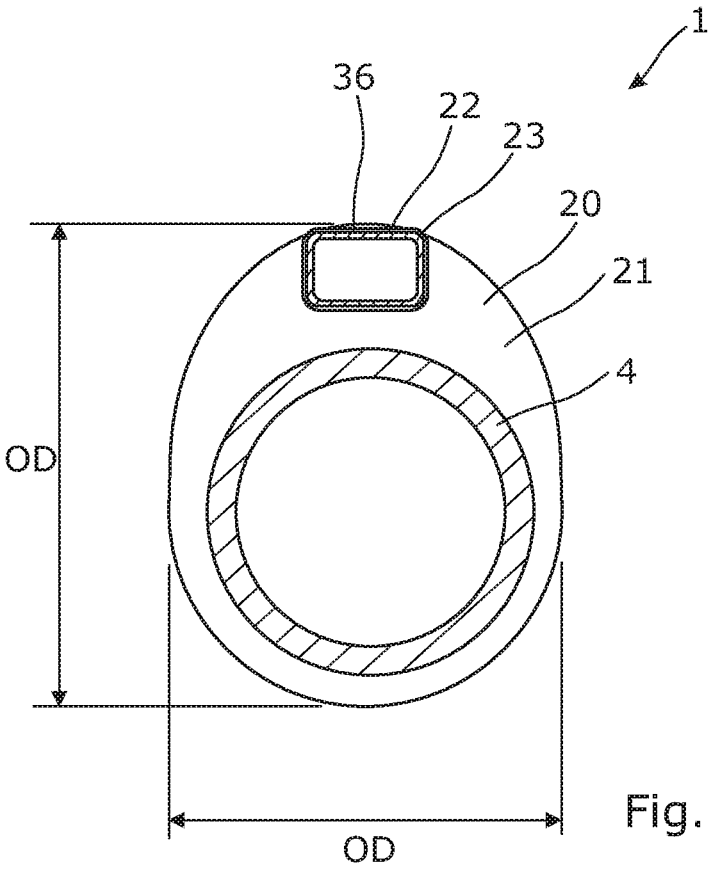
Figure 9:
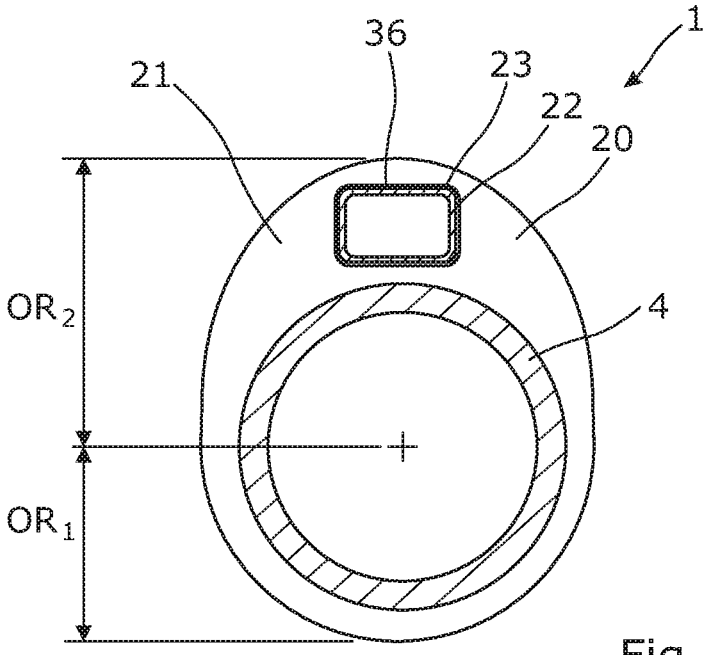
Figure 10:
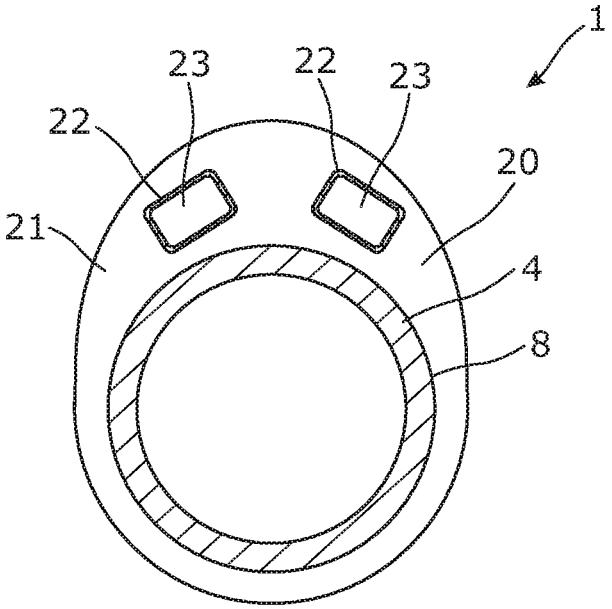
Figure 11:
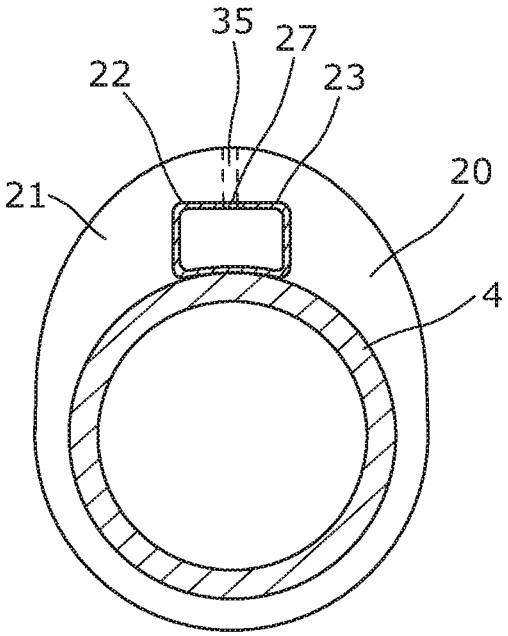
Figure 12:
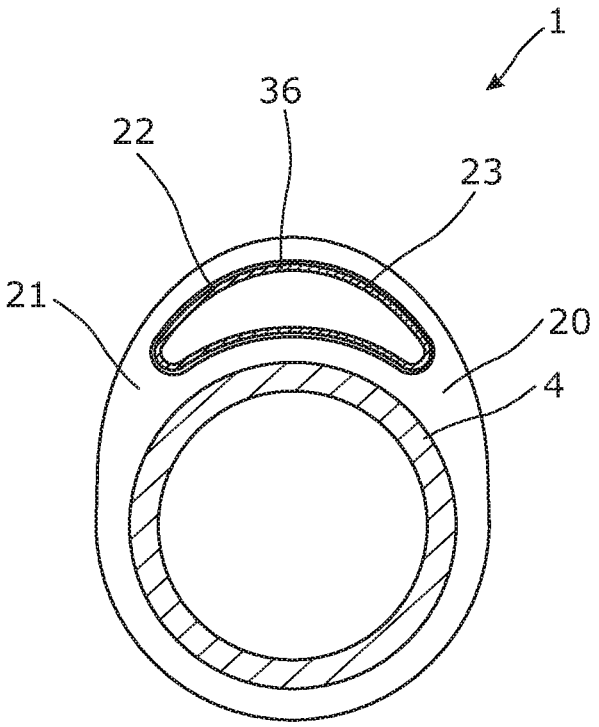
Figure 13:
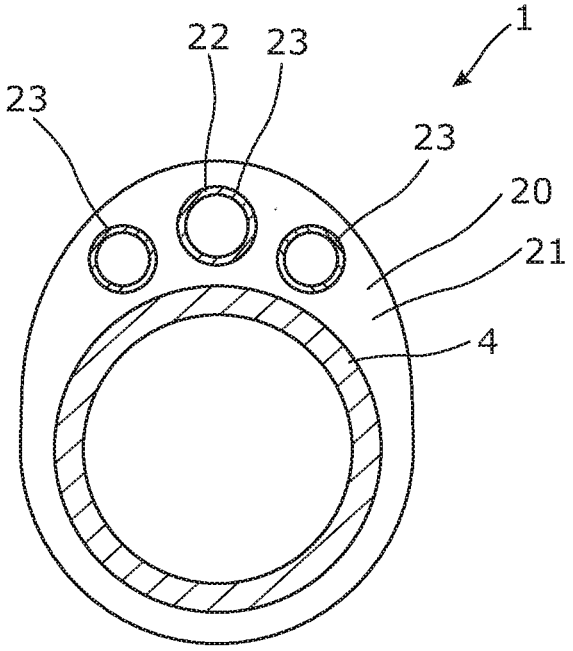

In FIG. 8, the opening 22 in the wall 21 of the tubular metal connection assembly 20 is arranged as a recess in the outer face of the wall and the shunt tube 23 is arranged therein. The opening has a cross-section area, the cross-section area being larger than 2 $cm^2$, preferably larger than 4 $cm^2$ and even more preferably larger than 7 $cm^2$, as shown in FIGS. 8, 11 and 12. In FIGS. 10, 13 and 14, each opening has a cross-section area which is larger than 2 $cm^2$, preferably larger than 4 $cm^2$, and the common cross-sectional area is preferably larger than 4 $cm^2$ and more preferably larger than 8 $cm^2$. The opening in the wall 21 has a cross-sectional shape which in FIGS. 13 and 14 is circular, in FIG. 12 is bean-shaped, and in FIGS. 8-11 is square-shaped or substantially square-shaped in that the opening has rounded corners. The shunt tube has matching cross-sectional shapes as shown in FIGS. 8-14. A sealing means 36 is arranged between the opening and the shunt tube, so that the pressure in the production zone/annulus is not equalised unintentionally with the pressure in the expandable space of the annular barrier. In FIGS. 8-13, the tubular metal connection assembly 20 has an oval shape with a circular hole for receiving the tubular metal part 4, and in FIG. 14 the tubular metal connection assembly 20 is circular and round with the circular hole for receiving the tubular metal part 4. By having several openings as shown in FIG. 14, the tubular metal connection assembly 20 does not need to be oval but then a shunt collection unit 17 shown in FIG. 2 is required.

In FIG. 11, the opening 22 is provided in the inner face of the tubular metal connection assembly 20 as a recess in which the shunt tube 23 is arranged. The shunt tube may have an expansion opening 27 arranged opposite the annular space through which pressurised fluid may enter into the annular space in order to expand the expandable metal sleeve. The tubular metal connection assembly 20 comprises a fluid channel 35 for fluidly connecting the expansion opening and the space. Thus, the expandable metal sleeve is expanded by pressurising the shunt tube and letting the pressurised fluid into the space through the expansion opening.

In FIG. 5, a downhole completion system 100 for completing a well 11 is shown. The well 11 has a top (not shown) near the surface or seabed and a borehole 10 into which the well tubular metal structure 5 extends. Two annular barriers 1 are mounted as part of the well tubular metal structure to isolate a production zone 101. A shunt tube 23 extends along the well tubular metal structure 5 from the top of the well through the annular barriers between the expandable metal sleeves and the tubular metal parts 4. The downhole completion system 100 further comprises several screen assemblies 30 mounted as part of the well tubular metal structure 5. Each screen assembly comprises a screen 31 surrounding a base part 32 which is mounted as part of the well tubular metal structure. The shunt tube 23 extends on an outside of the screen assembly between the screen and the base part of the screen assembly. The annular barriers are shown in their expanded position/state, in which the expandable metal sleeve abuts the wall 9 of the borehole 10. The shunt tube is not bent or diverted and extends in a straight line along the well tubular metal structure and thus has the same distance to the outer face 8 of the well tubular metal structure. The production fluid flows from the reservoir through the screen and in through production openings 34 in the well tubular metal structure 5.

In FIG. 6, the downhole completion system 100 further comprises an inflow control device 41 in a second production zone 101*b* which device is fluidly connected with the screen assemblies for receiving all fluid flowing in through the adjacent screen assemblies and thus controlling the inflow of production fluid into the well tubular metal structure 5. In FIG. 6, the inflow control device 41 is open and the flow of fluid is illustrated by arrows. The production fluid is, in a first production zone 101*a* and a third production zone and 101*c*, allowed to flow directly from the screen assembly into the well tubular metal structure through production openings 34. Sealing means 18 are arranged on the outer face of the expandable metal sleeve to provide a more efficient seal against the wall of the borehole.

In FIG. 7, the shunt tube has several sidetracks 37 along the well tubular metal structure opposite the screen assemblies, and the sidetrack extends on an outside of the screen assembly. In this way, the gravel 42 is led directly further down the well by the main shunt tube, and the gravel for the zone is ejected through the sidetracks, providing a more even flow through the main shunt tube 23 and thus a more efficient flow so that the gravel can flow as far down the well as possible. The arrows illustrate production fluid entering the well tubular metal structure.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. An annular barrier for isolating a production zone, the annular barrier having a first end and a second end, comprising:

a tubular metal part for mounting as part of a well tubular metal 5 structure, the tubular metal part having an outer face, an expandable metal sleeve surrounding the tubular metal part and having an outer face facing a wall of a borehole, each end of the expandable metal sleeve being connected with the tubular metal part, an annular space arranged between the expandable metal sleeve and the tubular metal part, the expandable metal sleeve being configured to expand by pressurised fluid entering the annular space, a first tubular metal connection assembly surrounding the tubular metal part connecting one end of the expandable metal sleeve with the tubular metal part and a second tubular metal connection assembly surrounding the tubular metal part connecting the other end of the expandable metal sleeve with the tubular metal part, each tubular metal connection assembly having a wall, and a shunt tube, wherein the tubular metal connection assemblies have at least one opening in the wall through which the shunt tube extends, the shunt tube extending along and outside the tubular metal part from the first end via the annular space to the second end, and wherein each said tubular metal connection assembly has an oval cross-section.

2. An annular barrier according to claim 1, wherein the expandable metal sleeve is tubular and connected to or forms part of an outer face of the tubular metal connection assemblies, so that the connection there between forms a circular connection when seen in cross-section.

3. An annular barrier according to claim 1, wherein the shunt tube is a gravel shunt tube.

4. An annular barrier according to claim 1, wherein the tubular metal connection assembly has a varying outer diameter.

5. An annular barrier according to claim 4, wherein the opening is provided in the wall part having the largest outer radius.

6. An annular barrier according to claim 1, wherein the oval cross-section includes a circular hole that receives the tubular metal part.

7. An annular barrier according to claim 6, wherein the circular hole is eccentrically located in the oval cross-section.

8. An annular barrier according to claim 7, wherein a first radius of each said tubular metal connection assembly as measured from a longitudinal axis of the circular hole to a first outer surface of the tubular metal connection assembly is greater than a second radius of the tubular metal connection assembly as measured from the longitudinal axis to a second outer surface of the tubular metal connection assembly opposite the first outer surface, the shunt tube being located along the first radius and between the first outer surface of the tubular metal connection assembly and an outer surface of the tubular metal part.

9. An annular barrier according to claim 1, wherein the shunt tube has several openings.

10. An annular barrier according to claim 1, wherein the opening has a cross-sectional shape which is bean-shaped, or substantially square-shaped.

11. An annular barrier according to claim 1, wherein each tubular metal connection assembly has an assembly length, the shunt tube has a shunt length and the expandable metal sleeve has a sleeve length in the unexpanded position, the shunt length being equal to or larger than the sleeve length and/or the assembly length.

12. An annular barrier according to claim 1, wherein the tubular metal connection assemblies and the expandable metal sleeve are made in one piece.

13. An annular barrier according to claim 1, wherein a connection member is arranged outside the tubular metal connection assembly, the connection member being configured to connect the expandable metal sleeve to the tubular metal connection assembly.

14. An annular barrier according to claim 1, wherein the tubular metal part has an expansion opening arranged opposite the annular space through which pressurised fluid may enter into the annular space in order to expand the expandable metal sleeve.

15. An annular barrier according to claim 1, wherein the shunt tube has a non-circular cross-sectional shape.

16. An annular barrier according to claim 15, wherein the non-circular cross-sectional shape is substantially rectangular.

17. An annular barrier according to claim 15, wherein the non-circular cross-sectional shape is substantially C-shaped with a concave part substantially matching a shape of an outside surface of each tubular metal connection assembly and a concave shape substantially matching a shape of an outside surface of the tubular metal part.

18. A downhole completion system for completing a well having a top and a borehole, comprising:

a well tubular metal structure adapted to extend in the borehole, and an annular barrier according to claim 1 and mounted as part of the well tubular metal structure, wherein the shunt tube extends along the well tubular metal structure from the top of the well through the annular barrier.

19. A downhole completion system according to claim 18, further comprising:

a screen assembly mounted as part of the well tubular metal structure.

20. A downhole completion system according to claim 19, wherein the shunt tube extends underneath the screen assembly.

21. A downhole completion system according to claim 19, wherein the shunt tube has several sidetracks along the well tubular metal structure opposite the screen assemblies.

22. A downhole completion system according to claim 21, wherein the sidetracks have openings.

23. An expansion method for expanding an annular barrier according to claim 1, comprising:

expanding the expandable metal sleeve of the annular barrier by letting the pressurised fluid into the space through an expansion opening in the shunt tube opposite the space.

* * * * *